US006951281B1

(12) United States Patent
Jeffery

(10) Patent No.: US 6,951,281 B1
(45) Date of Patent: Oct. 4, 2005

(54) PLUNGER HOLDER

(76) Inventor: Maudie M. Jeffery, 1254 W. 168th St. #5, Gardena, CA (US) 90247

( * ) Notice: Subject to any disclaimer, the term of this patent is extended or adjusted under 35 U.S.C. 154(b) by 9 days.

(21) Appl. No.: 10/462,061

(22) Filed: Jun. 16, 2003

(51) Int. Cl.[7] ..... B65D 83/10
(52) U.S. Cl. ..... 206/349; 206/361
(58) Field of Search ..... 206/15.2, 15.3, 206/209, 349, 361, 581; D6/551; 15/104.94, 15/244.1; 150/154; 220/253, 255; 312/206, 312/207

(56) References Cited

U.S. PATENT DOCUMENTS 2,757,787 A * 8/1956 Sergent ..... 206/361
4,847,939 A * 7/1989 Derencsenyi et al. ..... 206/361
5,114,006 A 5/1992 Wilk
5,836,322 A * 11/1998 Borger et al. ..... 206/361
5,924,566 A 7/1999 Gibbs
5,941,379 A * 8/1999 Barardo ..... 206/209
5,984,100 A * 11/1999 Ramsey et al. ..... 206/361
D419,019 S 1/2000 Shafik
6,601,700 B1 * 8/2003 Rudnick et al. ..... 206/349

* cited by examiner

*Primary Examiner*—Luan K. Bui
(74) *Attorney, Agent, or Firm*—Chris Papageorge

(57) ABSTRACT

A plunger holder includes a base which is cylindrical and has a bottom surface which is generally straight so that the holder to enable stable positioning thereof on a floor surface. The base has an upwardly curved convex floor and cylindrically shaped outer walls which surround the lower end of the plunger when the plunger is installed in the holder. The holder includes an upwardly curved convex floor to generally securely retain the suction head of the plunger when inserted in the holder and placed on the base. The holder also includes a main body portion which is mounted on top of the base. The main body is generally bottle shaped to conform to the shape of the suction head of the plunger. The main body also includes a pair of shells connected to the base by means of a spiral interconnect. The spiral interconnect also interconnects the shells to each other and enables relative rotation therebetween in order to open and close the shells to provide access to the holder in order to allow the plunger to be placed within the holder or withdrawn therefrom.

20 Claims, 7 Drawing Sheets

PLUNGER HOLDER

BACKGROUND OF THE INVENTION

The invention relates generally to household implements. More particularly, the invention relates to devices for containing portions of a toilet plunger and for holding it in a desired upright position on a bathroom floor surface location or various other types of desired locations.

A typical household usually has a plunger implement for use in the event of a blockage in a toilet or in another type of drain. In many households the plunger is stored in the bathroom in open view because of the difficulty of finding a location which can allow a wet plunger to be placed therein without the liquid draining from the plunger causing unsanitary contamination or some other type of damage to the area. Moreover, many people are reluctant to pick up and transport a plunger to another room immediately after use when it is dripping wet due to the likelihood of it dripping liquid in other household areas necessitating disagreeable cleanup or damage repair. In addition, the relatively large size of the typical plunger makes it difficult to store in homes which have limited storage space.

Due to faulty plumbing design or unreasonable use of garbage disposal units and the like, many households have frequent drain problems making it more convenient for the plunger to be stored close to the problematic drains. Sometimes, drain blockages can result in overflow causing water damage to wood floors, odorous contamination of an area, mold formation in carpeting or other types of damage to the surrounding household area. Such an overflow can happen very quickly making such blockages a potentially emergency situation. Due to these factors, storage of the plunger in an easily accessible location such as beneath the sink, or next to the bathtub or the toilet is deemed necessary in many households. But, plungers are typically designed for functionality rather than aesthetics. The functional design results in a typical plunger having a relatively large unsightly rubber bottom portion which is composed of a material capable of withstanding immersion in liquids containing various types of organic and inorganic materials. Moreover, the rubber bottom portion is required to be capable of providing a high degree of suction in order to free up oftentimes stubborn drain blockages. The need for high suction capabilities results in a bulbous shaped rubber bottom portion which is commonly perceived to be unattractive. Indeed, some people consider plungers ugly or perhaps gruesome in appearance and prefer that the plunger be out of their field of view. As a result, etiquette-conscious or aesthetic-conscious homeowners do not keep the plunger in the bathroom close to the commode but rather keep it out of sight somewhere else where it is not easily accessible and thereby detracting from the usefulness of such implements particularly in emergency situations.

Toilet plungers are commonly perceived to be unsanitary because it is likely they have come into close contact with toilet bowl liquids containing unsanitary substances commonly found therein as well as drain pipe liquids containing moldy garbage and the like. Consequently, many people consider plungers disgusting and for this reason do not want to clean and sanitize the plungers. Such household implements are therefore a habitat for disease germs presenting a risk for young children who commonly crawl around on floor surfaces and are not reluctant to come into tactile and oral contact with whatever objects happen to be on the floor. Consequently, people do not want plungers to be close by or within their view. What results is a dilemma wherein the plunger needs to be in a certain location where it is readily accessible but no one wants to see it there or allow it to remain there longer than absolutely necessary.

In attempting to address these concerns, many types of devices and structures have been designed to either conceal the plunger or to provide easy transportation thereof. Some of these more popular designs have sought to cover up the entire plunger with something more attractive. An example of such a design is U.S. Pat. No. 5,114,006 to Wilk. The Wilk invention is essentially a holder for a plunger in which the holder casing has a variety of decorative shapes. The Wilk casing includes two members which allow it to open and close for insertion of the entire plunger therein. However, because this design covers the entire plunger including the handle it adds a lot of bulk to the household implement requiring a relatively large storage area for it. Since this requires that the storage area be both large and conveniently located, this holder disadvantageously limits the number of storage spaces that are suitable. The larger size of this holder relative to the plunger also draws an inordinate and undesirable amount of visual attention to it. This type of design also adds more size and weight to the entire implement making it more difficult and inconvenient to transport. The upper portion of the Wilkes structure which covers the plunger handle is also thick making it more difficult to transport.

Other types of plunger holder designs solely provide coverage of the stick portion of the plunger. An example of such a design is disclosed in U.S. Pat. No. 5,924,566 to Gibbs. The Gibbs invention is a rigid structure which is composed of two main portions the upper portion of which opens to allow insertion of the plunger. However, the upper portion opens down rather than laterally requiring the user to stoop over to an excessive degree in order to operate resulting in undue back strain. More importantly, however, the Gibbs invention does not cover the rubber suction head of the plunger which is the most unsightly part thereof. Since the unsightly part of the plunger is not concealed by the Gibbs invention, the Gibbs invention does not address the unattractiveness problem presented by plungers. Consequently, these types of holders have limited value in the typical household.

Another prior art design which is designed to provide coverage as well as protect the surrounding area from liquid drainage from the plunger is disclosed in U.S. Pat. No. D419,019 to Shafik. The Shafik invention has a half collar fitting around the plunger stick and has a half open bottom portion which conforms to the shape of the plunger head. This holder also has a circular base which covers the rim of the plunger and thereby functions to contain water inside the holder. However, a primary disadvantage of such designs is that much of the plunger is exposed thereby detracting from the decorativeness such designs may otherwise provide.

The above described devices and structures do not provide both decorativeness and ease of transportation. They also do not provide easy installation and removal of a plunger from such devices and structures. What is therefore needed is a plunger holder which covers the objectionable part of the plunger and adds decorativeness to the entire structural combination of plunger and holder. What is also needed is a holder which leaves the plunger handle exposed allowing convenient transportation thereof and thereby also minimizing added weight. What is also needed is such a plunger holder which has portions which can be laterally opened and closed thereby minimizing back strain that may otherwise be caused by excessive stooping over to install and remove the plunger from the holder. What is further needed is a holder which protects the surrounding area from plunger liquids and additionally allows the plunger to dry out after use.

SUMMARY OF THE INVENTION

It is a principal object of the present invention to provide a plunger holder which provides decorativeness to the combination of plunger and holder when used to hold the plunger.

It is also an object of the present invention to provide a plunger holder which completely conceals the plunger head to obviate the unsightliness of the plunger when it is being stored.

It is also an object of the present invention to provide a plunger holder which exposes the handle of the plunger in order to facilitate transportation of the plunger together with the holder when the plunger is installed in the holder.

It is an object of the present invention to provide a plunger holder which may be manually opened and closed to provide easy access thereto and thereby facilitate proper insertion of the plunger therein as well as removal therefrom.

It is also an object of the present invention to provide a plunger holder which generally conforms to the shape of the plunger for enhanced compactness so that it is not an impediment in the household and for reduced bulk and weight for ease of storage and transportation.

It is yet another object of the present invention to provide a plunger holder which is structurally simple for reduced manufacturing costs.

It is still another object to the present invention to provide a plunger holder which has a straight bottom surface allowing the holder to be placed on a bathroom floor surface or any other type of flat surface so that it may be placed in any desired location for enhancing its accessibility.

It is also an object of the present invention to provide a plunger holder which provides drainage of plunger liquids therefrom for allowing the plunger to dry out while in storage and out of view.

It is also an object of the present invention to provide a plunger holder for containing liquids which have drained from the plunger for protecting the surrounding area from such liquids.

Essentially, the plunger holder of the present invention is specifically designed for holding the plunger in a desired upright position so that it may be placed on a bathroom floor where it is conveniently located for quick use when needed. The holder of the present invention is also specifically designed for concealing the unsightly and unsanitary plunger portions. The holder additionally provides concealment of these plunger portions while also providing decorativeness to the entire combination of plunger together with the holder when the plunger is in use holding the plunger. In this way, it provides the dual benefit of concealing what is commonly considered ugly and disgusting while also adding a decorative furnishing to the household. The holder is composed of materials which may be produced in any desired color to match the decor of the room in which it is placed thereby further enhancing its decorative appeal.

A primary shortcoming of conventional plunger holders is that they cover up too much of the plunger thereby detracting from its utility by making it too bulky and therefore less easy to transport. In contrast, however, the holder of the present invention is a relatively small structure covering only the plunger head. In this way it not only minimizes bulk and weight but also exposes the plunger handle thereby allowing the user to grab the handle of the plunger for ease of transportation thereof. In addition, the plunger handle is not generally considered objectionable in appearance and there is thus no benefit to be derived from covering it up, as do some conventional plunger holders. However, covering up the handle renders it inaccessible and thereby prevents it from being used as intended. Consequently, the holder is provided with a circular aperture through which the handle of the plunger protrudes leaving it accessible so that a user can easily grip any part of it. This allows the user to easily pick up and move the holder together with the plunger to any desired location. It additionally allows the user to easily pick up and move the plunger into and out of the holder.

It is a primary objective of the present invention to provide a holder which enables ease of installation of the plunger into the holder and removal therefrom. This is accomplished via the unique upper and lower portion design of the holder wherein the upper portion is a hollow structure open at both vertical ends thereof. The upper portion includes a pair of shells which are interconnected by a hinge to allow the shells to rotate horizontally so that the upper portion can open and close. Horizontal rotation of the shells allows the front of the upper portion to be opened so that the plunger can be inserted into the holder by moving it horizontally through the front of the upper portion and into the open area of the holder.

The hinge also connects the upper portion to the lower portion. The hinge preferably connects these portions together at only a rear portion thereof thereby minimizing the weight of the holder. The minimal size of the hinge enables more of the holder to be composed of the upper and lower portions which are made of a material that is very amendable to decorative colors and designs. The hinge is preferably a wire formed into a spiral shape which passes through holes in lateral ends of the shells at rear portions thereof and also through apertures in the base at a rear portion thereof. The wire moves freely through the apertures enabling rotation of the shells. This spiral wire which interconnects these holder members is structurally strong due to its material composition and wire thickness as well as spiral shape yet lightweight and thereby enables the shells to be held together and held onto the base thereby providing structural strength to the base and shells combination with a minimum of weight. The spiral design of the interconnect also provides a desired degree of rigidity to the base and shells combination. The spiral shape also effectively joins the generally rigid upper and lower portions together thereby making the combination structurally strong. The spiral interconnect design also minimizes bulk of the holder and its thinness and curvature adds a degree of attractiveness to the holder.

The present invention also obviates the messy characteristic of a plunger right after use during which it is likely to drip oftentimes foul liquids from the toilet bowl or drain pipe. To eliminate or reduce the mess that may otherwise result, the present invention incorporates a uniquely structured design which includes a lower portion (or base) which has a floor on which the plunger head is placed and a channel positioned below the head which receives and contains the liquids from the plunger head. The floor and channel thus allow the plunger head to drain to minimize odors that may otherwise result and also keep the bathroom area free from contamination from plunger head liquids.

The holder is shaped like a squat bottle, and the main body is generally frusto-bottle shaped to conform to the shape of the plunger suction head. This particular shape minimizes the size of the holder thereby making it more compact and more lightweight. Its compactness makes it more desirable as a decorative furnishing because it is not appreciably larger than the plunger yet performs the desired function of concealing ugly portions of the plunger while allowing it to be placed where it is most convenient in the event the plunger needs to be used.

DETAILED DESCRIPTION OF THE PREFERRED EMBODIMENT

Figure 1:
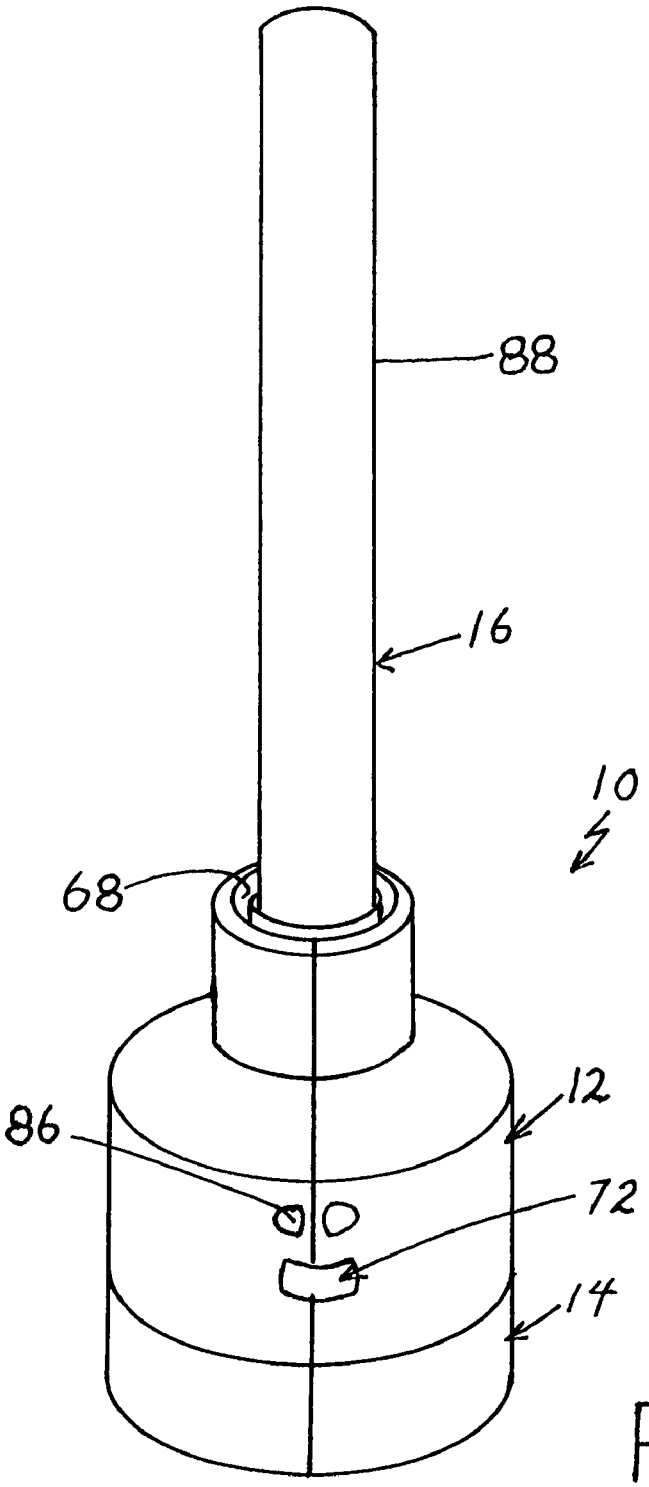
FIG. 1 is a perspective view of the plunger holder of the invention showing the plunger properly installed in the holder and showing the main body in a closed position.

Referring to the drawings, the plunger holder of the present invention is generally designated by the numeral 10. The holder 10 preferably includes an upper portion 12 and a lower portion 14. The upper portion 12 is preferably hollow for receiving the plunger 16 therein. More specifically, the hollow inner area 18 of the upper portion 12 receives an elastomeric suction head portion 20 of the plunger 16. For this reason, the upper portion 12 is curved into a frusto-bottle shape to generally conform to the shape of a typical plunger suction head 20. This shape in conjunction with the sizing of the upper portion 12 thus leaves no appreciable free space within the inner area 18 when the plunger suction head 20 is positioned therein.

Figure 2:
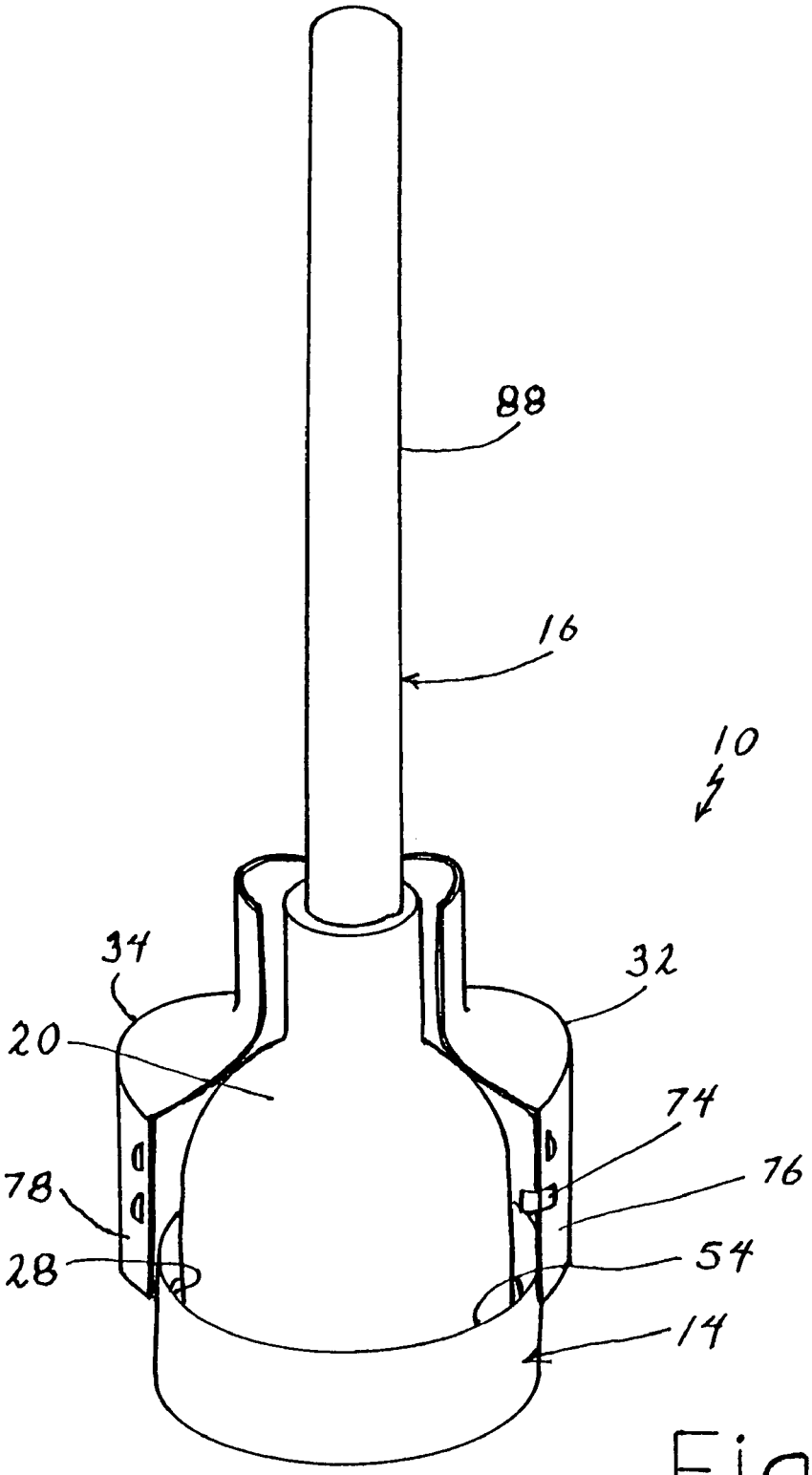
FIG. 2 is a perspective view of the plunger holder of the invention showing the plunger properly installed in the holder similar to FIG. 1 but showing the main body open illustrating the positioning of the plunger on the floor of the base component of the holder.
Figure 3:
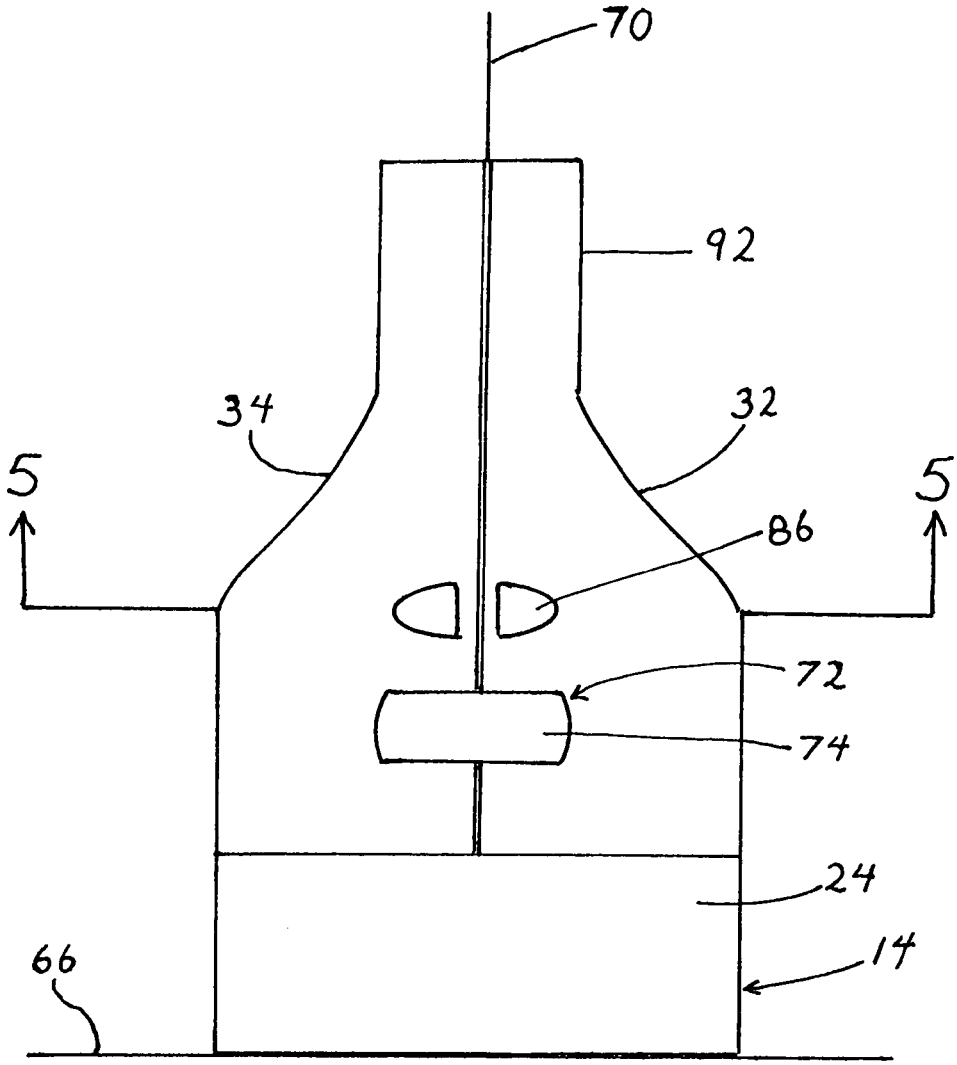
FIG. 3 is a front plan view of the plunger holder of the invention showing the holder in detail.
Figure 4:
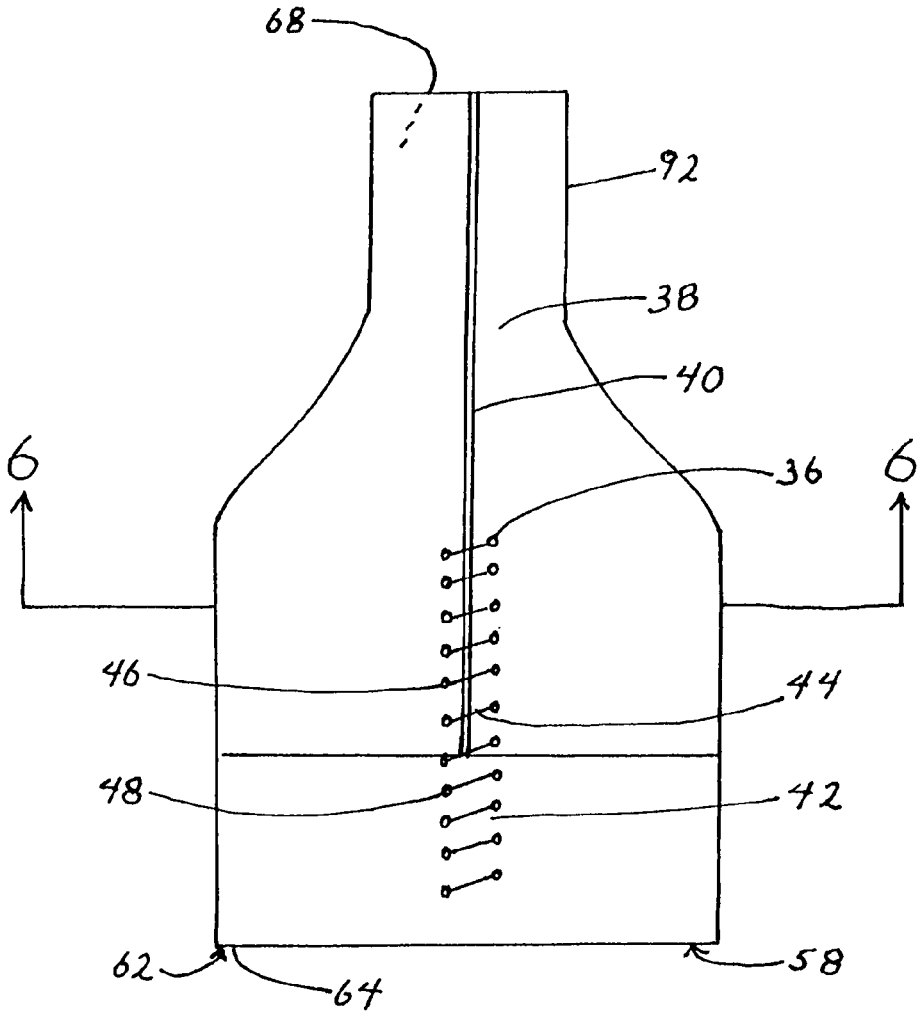
FIG. 4 is a rear plan view of the plunger holder of the invention showing the holder in detail.

The upper portion 12 is preferably mounted on top of the lower portion 14, as shown in FIGS. 3 and 4. The lower portion 14 preferably includes a floor portion 22 and an outer wall 24 connected to the floor portion at the perimeter 26 of the lower portion 14. The outer wall 24 is preferably cylindrical and extends upwardly from the floor portion. The floor portion 22 and the outer wall 24 define a cavity 28 into which the bottom portion 30 of the plunger head 20 is placed when the plunger is placed in the holder 10, as shown in FIG. 2.

The upper portion or main body 12 preferably includes a pair of shells 32 and 34. The shells 32 and 34 are preferably interconnected by a hinge 36. The hinge is connected to the rear lateral end portions 38 of the shells 32 and 34, as shown in FIG. 4. The lateral edges 40 of the lateral end portions 38 are preferably vertically oriented and straight. This enables the hinge 36 to enable horizontal rotation of the pair of shells 32 and 34 relative to each other and relative to the base 14. Rotation of the shells 32 and 34 is preferably accomplished manually and produces opening and closing of the main body 12. The hinge 36 provides free rotation so that the shells may both be rotated simultaneously in a horizontal direction toward and away from each other or either shell may be rotated alone horizontally and outwardly toward and away from the other shell. This free rotation also facilitates manual rotation of the shells 32 and 34. The hinge 36 provides shell rotation enabling the main body to be opened which allows access to the open inner area 18 of the main body thereby allowing the plunger head 20 to be inserted therein.

Figure 5:
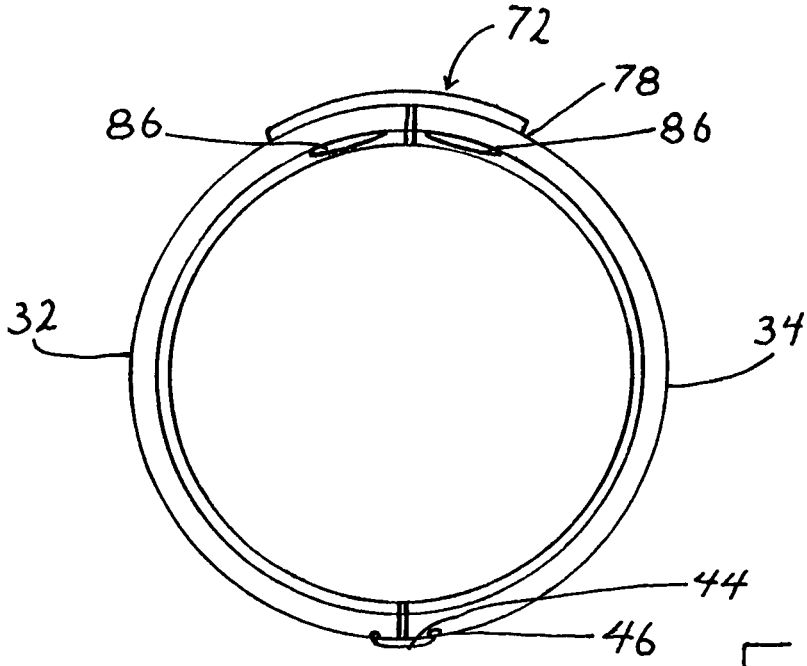
FIG. 5 is a cross-sectional view of the plunger holder of the invention taken along lines 5—5 of FIG. 3 showing the component latch in detail.
Figure 6:
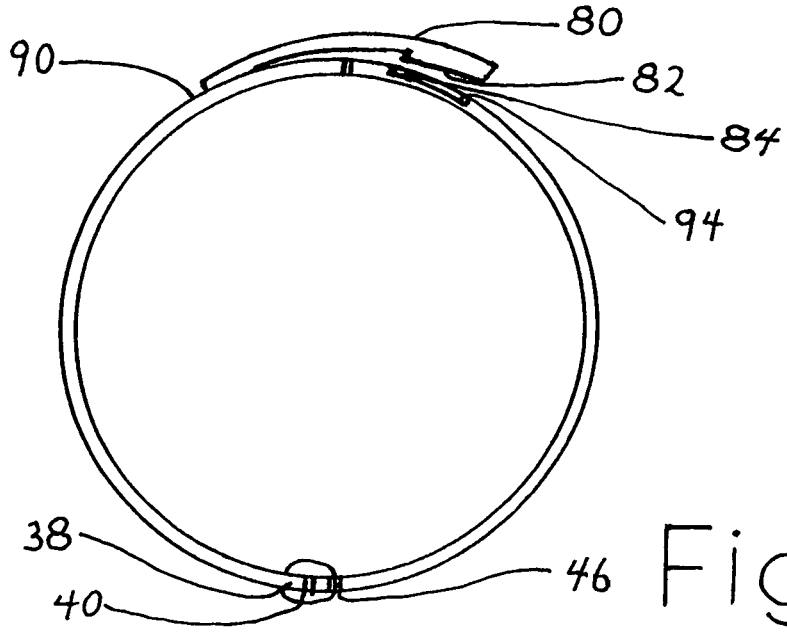
FIG. 6 is a cross-sectional view of the plunger holder of the invention taken along lines 6—6 of FIG. 4 showing the component finger grip structures in detail.
Figure 7:
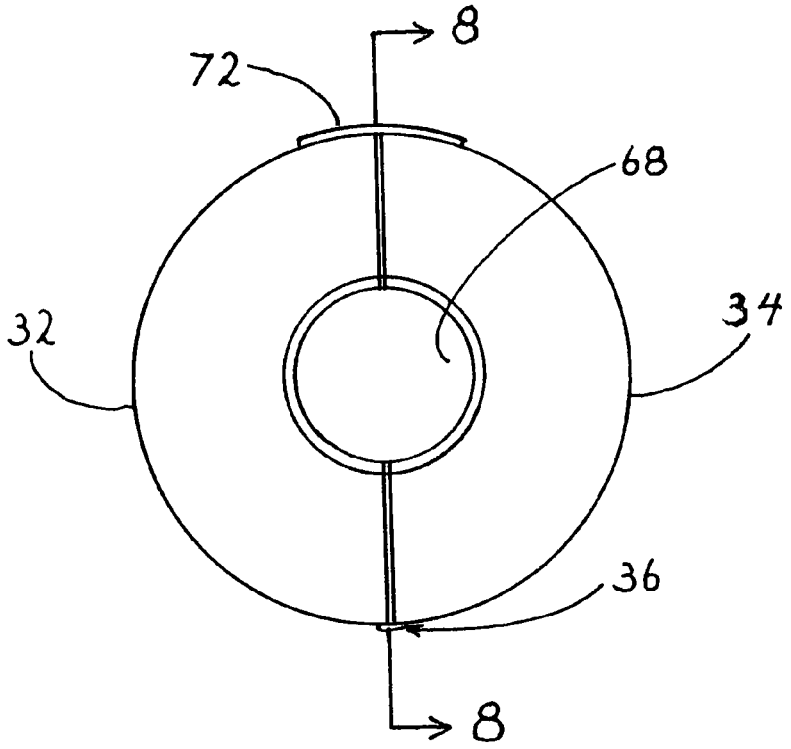
FIG. 7 is a top plan view of the plunger holder of the invention.

The main body is preferably connected to the lower portion or base 14 also by means of the hinge 36. The hinge 36 is preferably connected to the base 14 at a rear portion 42 thereof, as shown in FIG. 5.

The hinge 36 is preferably a wire in the shape of a spiral which extends vertically. The hinge is thus a spiral interconnect 36 having elongate members 44 twisted or wound into a spiral shape. The spiral interconnect 36 is thus preferably a unitary structure. The elongate members 44 preferably extend into and through apertures 46 in the lateral end portions and through apertures 48 in the base rear portions. The elongate members 44 are preferably slightly thinner than the apertures 46 and 48 to allow free movement of the elongate members through the apertures 46 and 48. This provides free rotation of the shells 32 and 34. The elongate members of the spiral are preferably thin relative to the width of the spiral interconnect 36 and are preferably composed of metal for high strength. The spiral interconnect thus provides structural strength to the holder by providing a relatively narrow and lightweight yet structurally strong interconnection between the shells and the base. The spiral interconnect 36 in conjunction with the close fit of the main body 12 around the plunger head 20 enables the plunger and holder 10 together to be picked up by a user and carried without excessive movement of the plunger 16 within the holder 10.

The floor portion 22 of the base 14 is preferably upwardly curved at its medial portion 50 so that it is thus convex. The convex (or semi-spherical) shape positions the medial portion 50 (which is higher than outer portions 52) within the suction head 20 when the plunger is properly installed in the holder 10 and properly positioned on the base 14. The rim 54 of the plunger head 20 rests on the outer portions 52 so that the higher medial portion essentially functions to limit lateral movement of the suction head 20 on the base 14 so that it holds the suction head on the floor portion minimizing lateral movement of the suction head on the floor portion. The convex shape of the floor portion thus serves to retain the suction head 20 and thereby the entire plunger 16 on the base 14 and within the cavity 26. This provides a more stable structure when the plunger 16 is being held by the holder 10.

Figure 8:
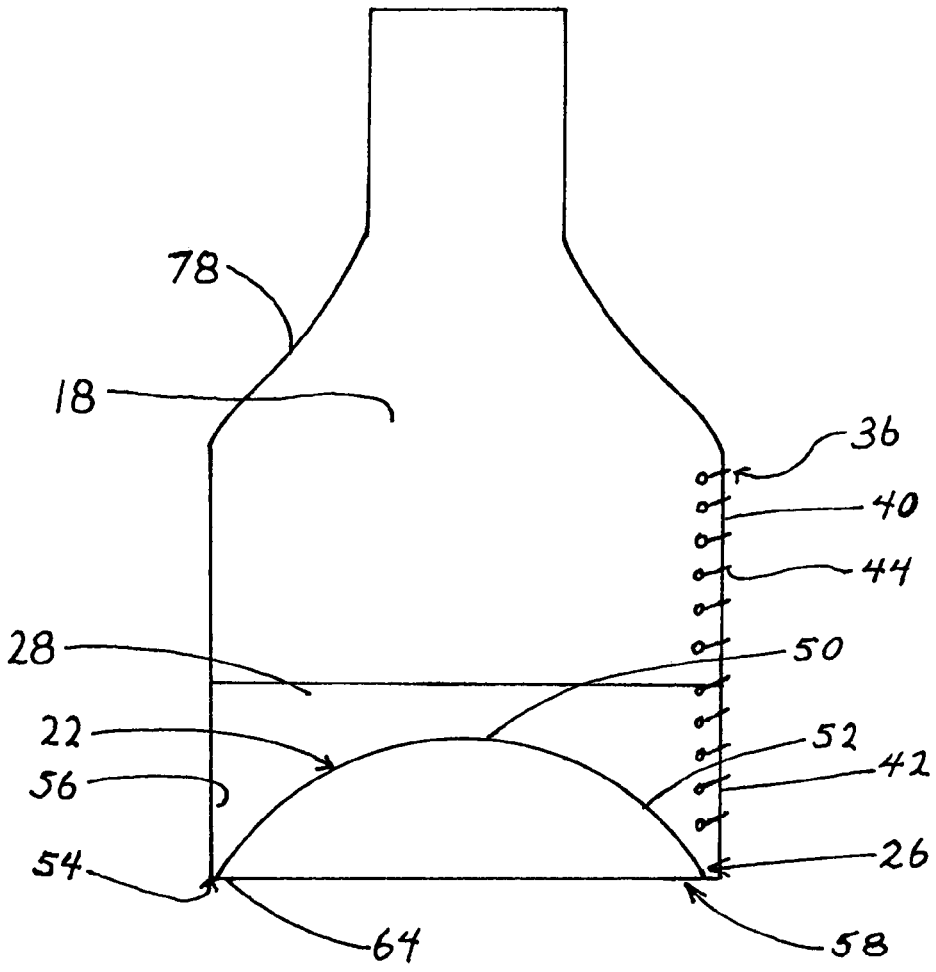
FIG. 8 is a longitudinal sectional view of the plunder holder of the invention taken along lines 8—8 of FIG. 7 showing the curvature of the floor of the base.

The walls 24 and the outer portions 52 define a channel 56 which is narrow at its lower portion. The channel 56 is located at the perimeter 26 of the base 14 and forms an acute angle at its lower portion and expands upwardly to form a wider angle at more upward portions of the channel, as shown in FIG. 8. The channel 56 receives and contains liquids that drain from the suction head 20 after use thereof. The channels enable the wet suction head 20 to dry out while in the holder 10 while it is in storage or otherwise simply out of view. It also enables relatively easy clean up of the liquids which may be easily accomplished by simply picking up and tilting the holder over a sink or similar structure so that the liquid pours out of the holder. Both the holder 10 and the plunger 14 are thus kept more sanitary than they otherwise would likely be without utilization of the holder 10 which provides this desirable feature. The bathroom or wherever the holder 10 and plunger 14 are kept is thus likely to be relatively odor-free.

The bottom 58 of the base 14 preferably has a concave portion 60. The base rim 62 is at the perimeter 26 of the base 14. The bottom surface 64 of the base rim 62 (and therefore also the base 14) is preferably straight so that the base can be placed on a flat floor surface and be stable thereon. The straight rim with a concave portion surrounding it enables the base to be placed on more uneven surfaces than an entirely flat bottom base surface can accommodate. The bottom surface 64 of the base rim 62 preferably lies in a flat plane 66. The base 14 and therefore the holder 10 together with the plunger 16 (when used to hold the plunger 16) can be placed on any desired household flat surface such as a bathroom floor, shelf, etc. and be stable thereon thereby adding to the convenience afforded by the holder design.

The main body 12 at upper portions 64 thereof preferably defines a hole 68. The hole 68 is medially positioned at the upper portions 64 and preferably surrounds and is concentric with the axis 70 of the main body 12 (and holder 10 generally). The axis 70 is also preferably normal to the plane 66. With this orientation of the bottom surface 64 and the hole 68, the handle 88 of the plunger extends through the hole, and the suction head is positioned on the convex floor surface so that the plunger is in a generally upright position for proper suction head 20 drainage and for easy gripping of the handle. More specifically, the hole 68 is located at the neck 92 of the holder 10 and the neck generally surrounds the upper, thinner portion of the plunger suction head.

In order to prevent the shells 32 and 34 which function as a pair of doors from swinging out by themselves and exposing the plunger to view, a latch 72 is provided on the shells. The latch 72 preferably comprises a latch member 74 on shell 32 which engages a recess 94 on shell 34. The latch member 74 preferably is located at and securely attached to the front lateral end portion 76 of shell 32 and extends laterally and tangentially from the curved outer surface 90 thereof toward the other shell 34. The recess is preferably located at the front lateral end portion 78 of shell 34. The latch member 74 includes a protruding member 80 which protrudes inwardly toward the axis 70 and is angled at its inner portion 82. The protruding member 80 engages a ledge 84 in the recess 94 to thereby securely retain the edges 40 in a joined relationship and keep the shells 32 and 34 closed. Manually pulling the latch member 74 outwardly results in separation of the latch member from the recess 94 and ledge 84 allowing opening of the shells 32 and 34 providing access to the inner area 18.

The main body 12 includes a pair of finger grips 86 which are a pair of indentations 66 at the front lateral end portions 76 and 78. The indentations are dimensioned to receive the finger tips of a typical user to thereby facilitate manually opening and closing the shells 32 and 34.

The main body 12 and base 14 are vertically dimensioned to generally enclose the plunger suction head 20 while leaving the plunger handle 88 exposed. Since the plunger handle serves a useful function in that it facilitates transporting the plunger, exposing the handle 88 allows it to be used as intended. In addition, the handle does not typically come in contact with drain liquids and is not unsanitary. Moreover, the material and shape of the handle are not ordinarily deemed unsightly. Thus, exposure of the handle 88 obviates the need to make a handle member out of the holder structure which would undesirably add weight and bulk to the holder. Consequently, exposure of the handle 88 advantageously results in a lighter and more compact holder thereby making it more convenient to transport. Moreover, a smaller holder is more likely to fit in with various types of bathroom decor.

The main body and base are preferably composed of plastic which is readily amenable to coloration in any of a variety of suitable colors that match the bathroom decor, such as, for example, dark green, purple, etc. In addition, the plastic composition makes the holder relatively lightweight.

Accordingly, there has been provided, in accordance with the invention, an improved holder for a toilet or drain plunger which provides enhanced decorativeness in the user's household and enhanced convenience to the user. It is to be understood that all of the terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include such alternative embodiments, modifications and variations that fall within the spirit and scope of the invention as set forth in the claims hereinbelow.

What is claimed is:

1. A plunger holder for holding and enclosing a plunger, comprising:

a base, said base including a floor portion and an outer wall;

a main body positioned on top of said base, said main body having an upper portion defining an open inner area for receiving an elastomeric suction head portion of the plunger therein, said main body being curved and horizontally larger at its lower portion relative to its upper portion to form a generally frusto bottle shaped structure, said main body including a pair of shells;

a hinge for said pair of shells, said hinge interconnecting said base and said pair of shells to securely mount said main body to said base and to enable relative rotation between said base and each of said pair of shells said hinge interconnecting said pair of shells at lateral end portions thereof to enable horizontal relative rotation between said pair of shells so that the main body can open and close.

2. The plunger holder of claim 1 wherein said base has a horizontally straight bottom surface so that the plunger holder can be placed in a stable position on a typical flat floor surface.

3. The plunger holder of claim 2 wherein said base includes an outer lower portion which is circular and located at a perimeter of the base to enhance later stability of the holder when placed on the floor surface.

4. The plunger holder of claim 1 wherein said pair of shells includes a latch mounted on front lateral end portions thereof for detachable interconnection thereof to enable said main body to be retained in a desired closed position.

5. The plunger holder of claim 4 wherein said latch includes a latch member mounted at one of said front lateral end members said latch member including a protruding member and a cavity located at other of said front lateral end members in order that said protruding member engages said cavity in order to retain said pair of shells together and thereby retain said main body in a desired closed position.

6. The plunger holder of claim 1 wherein said pair of shells include a pair of indentations for receiving a user's digits to facilitate manual opening and closing of said main body.

7. The plunger holder of claim 1 wherein said main body and said base are vertically dimensioned to enclose only a suction head portion of the plunger.

8. The plunger holder of claim 1 wherein said main body includes a neck, said neck vertically elongate and cylindrical to generally conform to shape of a handle portion of the plunger.

9. The plunger holder of claim 1 wherein said outer wall and said floor portion define a channel, entire of said channel located at a lower perimeter of said base, said floor portion vertically sloped and a medial floor portion positioned higher than an outer floor portion of said base to allow liquid from the rubber body to drain down into said channel when said rubber body is positioned in said base.

10. The plunger holder of claim 1 wherein said floor portion is convex such that a medial floor portion thereof is higher than other portions thereof so that said medial portion is positioned within the suction head when the plunger is positioned in the holder in order to retain the suction head on said floor portion in a desired upright position within the base.

11. The plunger holder of claim 10 wherein said floor is semi-spherical in order to conform to the shape of the lower portion of the rubber body and thereby to retain the rubber body in a desired upright position on said floor of said base.

12. The plunger holder of claim 1 wherein said outer wall is cylindrical in order to conform to shape of the suction head.

13. The plunger holder of claim 1 wherein said base and said pair of shells are dimensioned to conform to size and shape of the suction head in order to retain the rubber body in the holder while allowing minimal horizontal and vertical movement relative thereto and therein.

14. The plunger holder of claim 1 wherein the holder includes an axis and wherein said base has a bottom surface which lies in a flat-plane, the axis approximately normal to the plane, and wherein said main body includes hole, the hole generally surrounds the axis and is concentric therewith in order that the holder thereby retains a typical plunger therein in a desired upright position.

15. The plunger holder of claim 1 wherein said pair of shells and said base are composed of a plastic material allowing coloration thereof in various shades.

16. A plunger holder for holding and enclosing a plunger, comprising:

a base, said base including a floor portion and an outer wall;

a main body positioned on top of said base, said main body having an upper portion defining an open inner area for receiving an elastomeric suction head portion of the plunger therein, said main body being curved and horizontally larger at its lower portion relative to its upper portion to form a generally frusto bottle shaped structure, said main body including a pair of shells;

a hinge for said pair of shells, said hinge interconnecting said pair of shells at lateral end portions thereof to enable horizontal relative rotation between said pair of shells so that the main body can open and close, said hinge including a spiral interconnect having elongate members which are positioned in apertures located in the lateral end portions of said pair of shells.

17. The plunger holder of claim 16 wherein said spiral interconnect is unitary.

18. The plunger holder of claim 16 wherein said spiral interconnect is composed of a rigid material.

19. The plunger holder of claim 16 wherein said spiral interconnect is composed of metal.

20. A plunger holder for holding and enclosing a plunger, comprising:

a base, said base including a floor portion and an outer wall, said floor portion sloped and entirely vertically curved and having a medial floor portion and an outer floor portion, said medial portion positioned higher than said outer floor portion;

main body positioned on top of said base, said main body having an upper portion defining an open inner area for receiving an elastomeric suction head portion of the plunger therein, said main body being curved and horizontally larger at its lower portion relative to its upper portion to form a generally frusto bottle shaped structure, said main body including a pair of shells;

a hinge for said pair of shells, said hinge interconnecting said pair of shells at lateral end portions thereof to enable horizontal relative rotation between said pair of shells so that the main body can open and close.

* * * * *